United States Patent [19]

Applegate

[11] 4,161,916

[45] Jul. 24, 1979

[54] INCINERATION APPARATUS WITH ADJUSTABLE AIR CURTAIN

[76] Inventor: Robert D. Applegate, P.O. Box 309, Attica, Ind. 47918

[21] Appl. No.: 834,516

[22] Filed: Sep. 19, 1977

[51] Int. Cl.[2] ..... F23G 3/02

[52] U.S. Cl. ..... 110/203; 98/36; 239/511; 110/240; 110/241; 126/271.1

[58] Field of Search ..... 110/203, 119, 240, 241; 126/271.1, 271.2 R, 271.2 A, 271.2 C; 98/36; 239/539, 504, 509–511

[56] References Cited

U.S. PATENT DOCUMENTS

| | | | |
|---|---|---|---|
| 1,644,072 | 10/1927 | Miller | 239/511 |
| 2,940,252 | 6/1960 | Reinhart | 239/511 |
| 3,143,952 | 8/1964 | Simons | 98/36 |
| 3,721,067 | 3/1973 | Agnew | 98/36 |
| 3,773,000 | 11/1973 | Applegate | 110/203 |
| 3,823,876 | 7/1974 | Hardy et al. | 239/511 |
| 3,899,984 | 8/1975 | Keyes et al. | 110/203 |

*Primary Examiner*—Henry C. Yuen
*Attorney, Agent, or Firm*—Luedeka & Hodges

[57] ABSTRACT

An apparatus for directing a curtain of air along a predetermined path into a pit in which material is burning from an elongated plenum positioned adjacent one margin of the pit. The air exits the plenum through an elongated nozzle assembly communicating with the interior of the plenum member. The path of the air from the nozzle is adjustable by means of a vane to enhance the oxidation of the burning materials and to reduce the amount of smoke produced.

4 Claims, 7 Drawing Figures

INCINERATION APPARATUS WITH ADJUSTABLE AIR CURTAIN

This invention relates to a system for controlling the supply of air to combustible material burning in a pit and more particularly concerns such a system having an improved nozzle for directing a curtain of air along a predetermined path to assist in enhancing combustion and in reducing the quantity of smoke and ash emanating from the pit during burning operations.

Combustible waste materials such as slash from a lumbering operation, leaves, yard trash, and other combustible solid waste materials are often disposed of by burning them in a pit dug in the ground or the like. In order to minimize the production of smoke and blowing ashes, means are provided for producing air currents which promote combustion and which produce an air curtain which minimizes the generation of smoke and minimize the escape of ashes from the pit.

The air curtain is produced in most operations by apparatus of the general type shown in U.S. Pat. No. 3,773,000. Apparatus of this type includes a fan which is powered by a suitable motor and which is connected by means of a duct to a plenum member which is placed along one edge of the pit. The plenum member is provided with an elongated outlet and a nozzle assembly for directing the air into the pit. With apparatus of this type, the direction of the air current has been controlled by changing the attitude of the nozzle by changing the attitude of the entire piece of equipment. Commonly, this is done by raising or lowering various portions of the equipment through the means of jacks or changing the level of the supporting ground surface so as to produce the desired attitude for the nozzle.

Obviously, such a means for adjusting the direction of the air current is cumbersome and time consuming. It is desirable to adjust the direction of air, as required, to obtain optimum incineration. For example, unless the direction of the air current is adjusted to accommodate varying quantities of material in the pit or to accommodate changes in the effective depth of the pit occasioned by ashes building up at its base, the air currents generated by the air supply system may blow ashes and other materials from the pit. Moreover, unless the air curtain is directed along a predetermined path within the pit during incineration of the flammable materials, incomplete oxidation may result in the generation of smoke which is especially undesirable in view of present environmental regulations.

Several problems are presented which make the provision of an adjustable nozzle in apparatus of this type difficult. First, the nozzle area is subjected to a substantial physical abuse. When materials of the type described are burned, they are usually dumped into the pit by dump trucks, pushed in by bulldozers, or by like means. As a result, pieces of large material such as logs and the like fall upon the nozzle with a force which will disable most adjustable devices. Also, the nozzle which extends adjacent the edge of the pit is subjected to elevated temperatures which also have an adverse effect upon the usual hinged joint or the like.

Accordingly, an object of this invention to provide an improved means for directing the air currents generated for pit incineration. A further object of this invention is to provide an improved nozzle for such a system adapted for directing the air curtain along a predetermined path which includes means for protecting the nozzle system from damage which may be occasioned by dumping materials into the pit and which will minimize the effect of heat from the pit. Other objects and advantages of the invention will become known from the following description and the accompanying drawings wherein.

Figure 1:
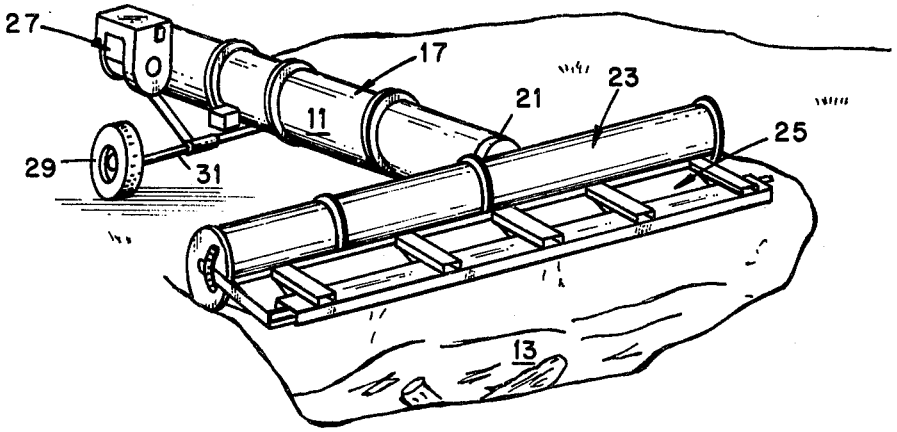
FIG. 1 is a perspective view showing apparatus of the class described and its use.
Figure 2:
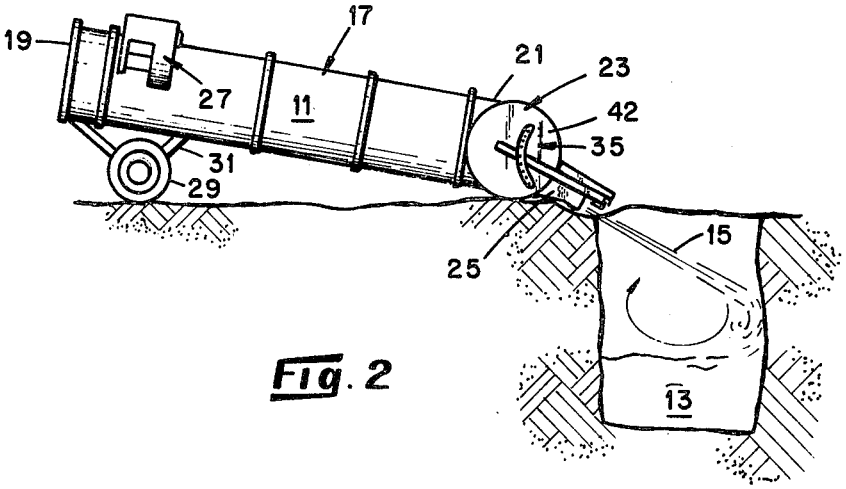
FIG. 2 is a side elevation view of the apparatus shown in FIG. 1.

FIGS. 1 and 2 illustrate in general apparatus 11 of the class described and its manner of use. As illustrated, the apparatus 11 is positioned adjacent the mouth of a suitable pit 13 to direct air into the pit to provide an air curtain 15 to enhance combustion. (While the term "pit" is used, the apparatus of the invention is equally applicable to any box like incineration enclosure, e.g. a box above ground, lined or unlined. Accordingly, the term "pit" as used herein refers to any enclosure which can be employed with an air curtain for controlled burning.) The apparatus 11 includes an elongated supply duct 17 having an inlet end 19 and an outlet end 21. The outlet end 21 of the supply duct 17 is connected to a plenum member 23. The plenum member 23 is positioned along one edge of the pit 13 as shown in FIGS. 1 and 2. The plenum member 23 is provided with an elongated nozzle assembly 25 which is positioned along a marginal edge of the pit and serves to direct the air current 15 into the pit 13.

Air is forced through the supply duct 17 by a blower assembly (not shown) at the inlet end 19 of the supply duct 17 which is driven by the engine 27.

The apparatus 11 is preferably mounted on a pair of transport wheels (one of which is shown at 29) by means of an axle and frame assembly 31 which is attached to the supply duct 17. Preferably, the supply duct 17 and the plenum member 23 are releasably connected together and hinged relative to one another so that the plenum member 23 can be rotated into a position parallel to the supply duct 17 for transport, all as shown in U.S. Pat. No. 3,773,000.

In operation, the assembly 11 is positioned adjacent the edge of the pit 13, as illustrated in FIGS. 1 and 2, the blower assembly 27 is energized to move air through the supply duct 17, through the plenum member 23, and through the nozzle assembly 25. This produces the air current 15 which circulates across the top of the pit 13, down along the remote side of the pit and across the material being burned to enhance its combustion. Thereafter, the air current 15 rises along the proximate side of the pit until it is deflected by moving air. In operation any smoke or burning ash which is carried up from the burning material 15 is subjected to the blast of incoming air thereby completing combustion and minimizing the escape of ash and smoke from the pit.

As pointed out above, this invention is concerned with the provision of a nozzle assembly 25 which is adjustable to direct the air current 15 along a predetermined path to enhance combustion and reduce the amount of smoke produced by the burning material depending upon the given conditions at any time.

More specifically, the exit nozzle assembly 25 is provided with a vane structure 33 which deflects the air current 15 into the desired path as its exits the nozzle assembly 25. The effect of the vane structure 33 is controlled by an adjusting means 35 which is remote from the nozzle assembly 25 so that the direction of the air stream 15 may be varied during operation. The vane structure 33 and its adjusting means 35 may take various forms, but it is desirable that they are constructed and positioned to minimize the effect of high temperatures and physical impacts.

Now describing the specific embodiment in detail, the plenum member 23 is fabricated from sheet material which is formed into a tube, the walls 37 of which are reinforced at suitable intervals by ring members 39. The walls 37 are provided with an elongated slot 41 which runs the entire length of the plenum 23. The ends of the plenum 23 are closed by end members 42.

Figure 4:
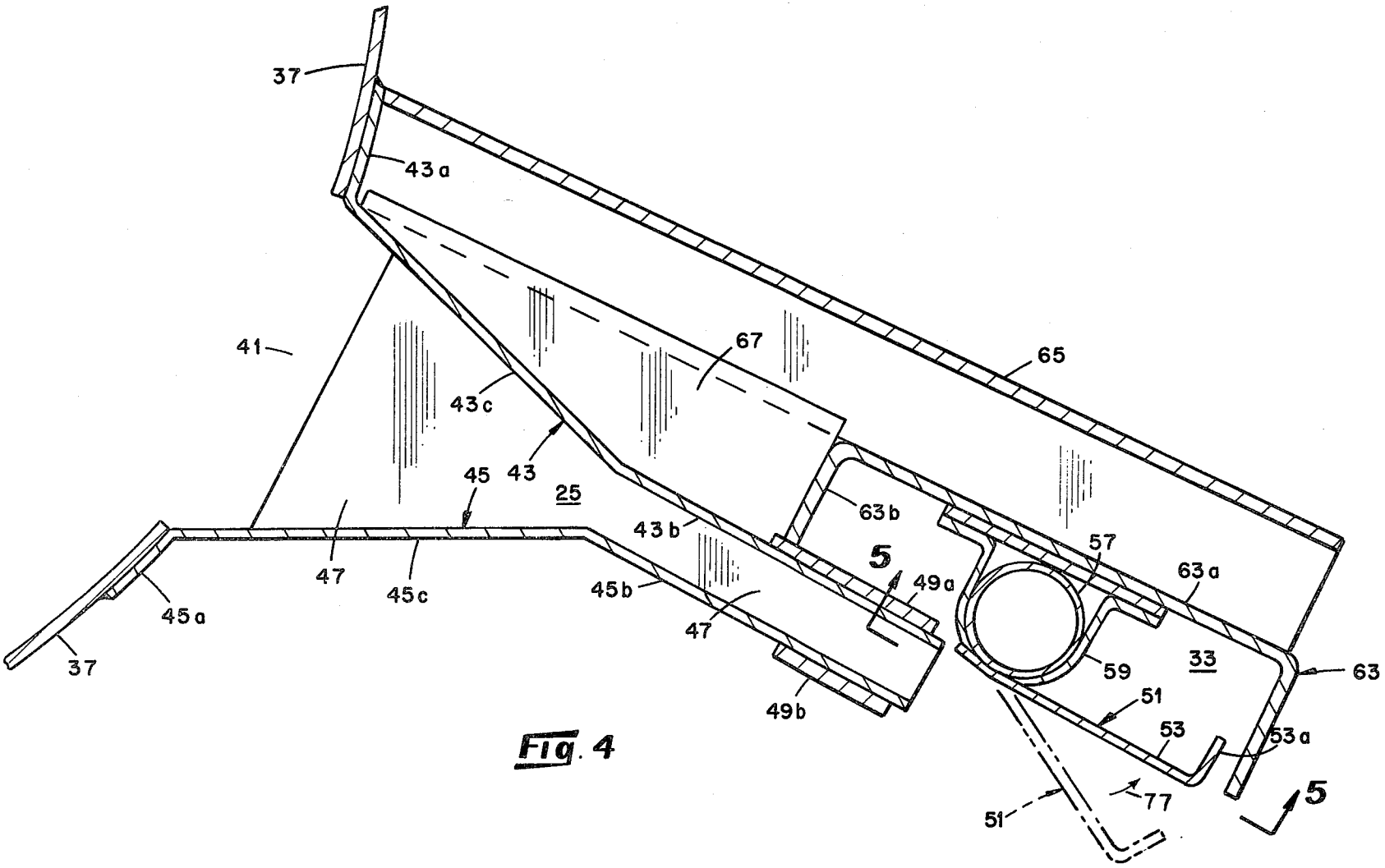
FIG. 4 is a sectional view taken along lines 4—4 in FIG. 3.

The construction of the nozzle assembly 25 is particularly shown in FIG. 4 and includes an upper nozzle wall 43 and a lower nozzle wall 45 which extend the entire length of the slot 41. The nozzle walls 43 and 45 are provided with attachment flanges **43*a* and 45*a*, respectively, each of which is rigidly attached to the wall 37 of the plenum member 23 on opposite sides of the slot 41 as by welding or the like. The ends of the nozzle walls 43 and 45, which are remote from the slot 41, include a flat nozzle section 43*b* and 45*b*, respectively. The nozzle walls 43 and 45 also include transition sections 43*c* and 45*c*** which interconnect their associated attachment flanges and nozzle sections.

As shown in FIG. 4, the nozzle sections **43*b* and 45*b* are generally parallel and spaced apart to direct air from the plenum 23 in an elongated curtain. The transition sections 43*c* and 45*c* are opposed and taper from the width of the slot 41 to the spacing between the nozzle sections 43*b* and 45*b* to decrease the cross section of the air stream emanating from the plenum 23**.

Figure 3:
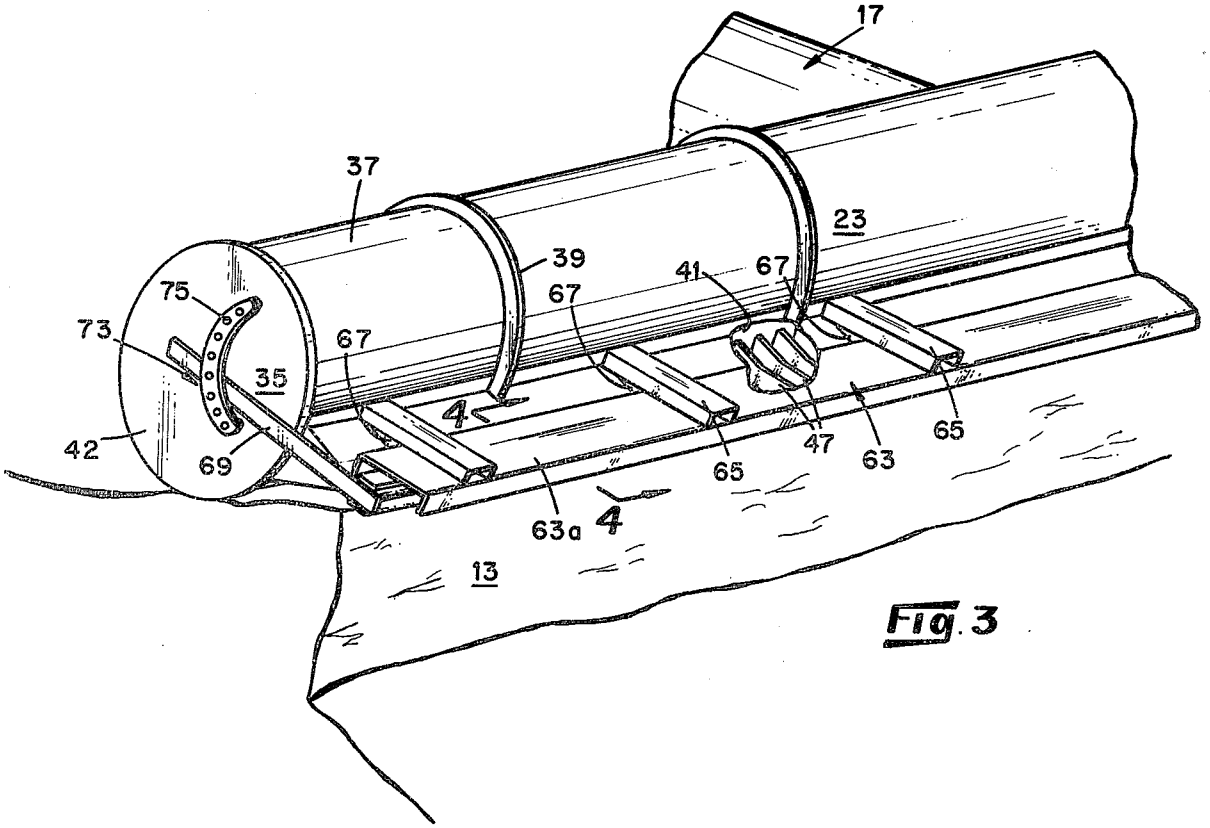
FIG. 3 is a fragmentary perspective view of a plenum and nozzle assembly embodying various features of the invention.

As illustrated in FIGS. 3 and 4, a number of spaced apart gusset plates 47 are provided intermediate the upper and lower nozzle walls 43 and 45. The gusset plates 47 are rigidly attached to the nozzle walls 43 and 45 to provide reinforcing for the nozzle assembly 25 from the plenum 23 to the outlet end of the nozzle. The plates 47 also provide vanes which insure that the flow of air from the plenum 23 through the slot 41 and out of the space between the nozzle sections **43*b* and 45*b* is in a path running at substantially right angles to longitudinal axis of the plenum 23**. The vanes thus provided also aid in dissipating heat.

In order to aid in obtaining a rigid, dimensionally stable structure, reinforcing members **49*a* and 49*b*, are rigidly attached to the nozzle sections 43*b* and 45*b*, respectively, adjacent their outer ends. The members 49*a* and 49*b*, preferably extend the entire length of the nozzle assembly 25** and are preferably bar sections, as illustrated, but may take any other suitable form.

Figure 5:
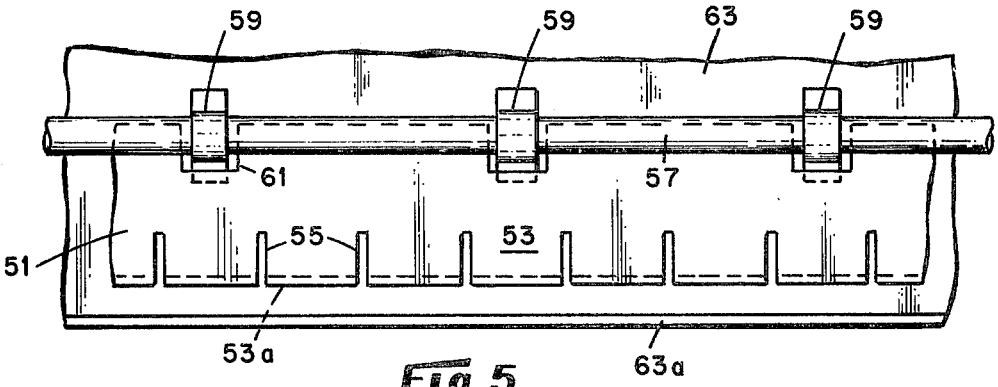
FIG. 5 is a fragmentary sectional view taken along lines 5—5 in FIG. 4.
Figure 6:
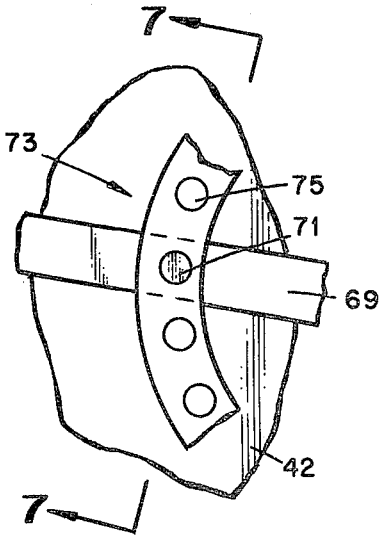
FIG. 6 is a fragmentary view of a portion of the adjusting means which is employed in the illustrated apparatus.
Figure 7:
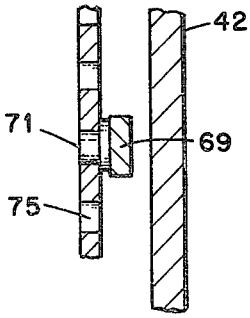
FIG. 7 is a fragmentary sectional view taken in line 7—7 in FIG. 6.

Control of the air stream from between the nozzle sections **43*b* and 45*b* is effected by a guide vane 51 which is positioned adjacent the outlet end of the nozzle sections 43*b* and 45*b*, the vane 51 lying in a plane adjacent to the upper boundry of the air stream which emanates from the nozzle sections. The illustrated vane 51 comprises elongated plate means 53 which extends the entire length of the nozzle. The plate 53 may be a single number, as illustrated, or a plurality of members which are joined together or otherwise interconnected. The plate means 53 includes a turned up flange 53*a* at its outer end to aid in maintaining the plate in a plane condition. Because the vane 51 is subjected to elevated temperatures from the burning material in the pit and is thus subjected to substantial heat expansion, spaces or slots 55 are provided in the plate means 53 which permit limited expansion without attendant buckling (FIG. 5). The spaces for the expansion may also be provided for by making the plate means 53** from a number of short plates which are mounted in a support in spaced apart relation.

In the illustrated device (FIGS. 4 and 5), the margin of the plate 53 remote from the flange is rigidly connected as by welding or the like to a pipe 57 which runs the length of the nozzle assembly 25. The pipe 57 is supported by generally U-shaped brackets 59 which are spaced apart along the length of the nozzle assembly 25. The plate 53, in the areas where the brackets 59 support the pipe, is provided with cut-out sections 61 to permit the brackets 59 to cradle the pipe 57 and to permit rotation of the pipe 57 and the associated vane 51 relative to the brackets 59. As pointed out above, instead of attaching a single elongated plate 53 to the pipe, the plate means 53 may comprise sections which may be spaced apart to provide for expansion.

Support for the brackets 59 and the pipe 57 is provided by an inverted channel member 63 which is rigidly attached to the plenum 23 by means of support channels 65 and gussets 67. As illustrated in FIGS. 3 and 4, the support channels 65 are welded or otherwise rigidly attached to the web **63*a* of the channel 63 at one end, and at the other end to the wall 37 of the plenum. The gussets 67 are positioned in the area bounded by the inner end of the channel member 65, the upper nozzle wall 43 and the nozzle wall attachment flange 43*a* and are rigidly interconnected with the channel 65, with the upper nozzle wall 43 and with the inner web 63*b* of the channel 63. This construction provides a rigid relationship between the plenum 23, the nozzle assembly 25 and the channel 63 which supports and protects the vane 51**.

As shown in FIG. 4, the U-shaped brackets 59 are attached to the underside of the web portion **63*a* of the channel 63 in a position which causes the portion of the plate 53 which is attached to the pipe 57 to be generally aligned with the end of the nozzle wall 43. The pipe 57 and attached vane 51 are protected from falling debris by the channel 63** and its support structure.

Adjustment of the position of the vane plate 53 is effected by the adjusting means 35 which includes in the illustrated embodiment a lever 69 which is attached at one of its ends to the end of the pipe 57 (FIG. 3). Intermediate its ends, the adjusting lever 69 is provided with a locking pin 71 which is engageable with an adjustment guadrant 73 having suitable locking holes 75. The adjustment quadrant is supported on the end 42 of the plenum 23.

In operation, the unit is set up on one side of the burning pit 13 with the nozzle assembly 25 being located closely adjacent the upper edge of the pit. The blower 27 is actuated to cause air to flow through the supply duct 17, through the plenum 23 and out the nozzle **43*b*, 45*b***.

In use it has been found that different air flow patterns are desirable for different combustible materials and/or for different amounts of material in the pit. Thus, the initial position of the nozzle is such that it is directed to provide an air stream along the uppermost path desired during the burning cycle. When the burning cycle is initially started, it is usually desirable to have the air stream directed to a lower position. This is accomplished by positioning the adjusting lever 69 at the upper point on the quadrant 73. The positioning of the adjusting lever 69 rotates the pipe 57 in its brackets 59 causing the vane 51 to assume a depressed position, e.g., as shown in dotted outline in FIG. 4. This directs the air stream downwardly to the desired point. As the burning progresses, the lever 69 is adjusted to rotate the pipe 57 and its associated vane 51 in the direction of the arrow 77 shown in FIG. 4, which raises the path of the air stream to obtain the desired burning efficiency.

In the foregoing, there has been described one specific embodiment of the invention. Various features of the invention which are believed to be new are set forth in the appended claims.

What is claimed is:

1. An apparatus for directing a curtain of air into a pit in which material is burning, including an air supply means, an elongated plenum member adapted to be positioned along one edge of the pit, said plenum member being in fluid communication with said air supply means for distributing air along the length thereof, a nozzle means attached to and extending along the length of said plenum and having an outlet for releasing the air from said plenum along its length in a stream moving generally at right angles to the length of said plenum, a vane located adjacent the outlet of said nozzle in proximity to said air stream, said vane being generally aligned with said nozzle, means to vary the position of said vane to change the path of said air stream and a protective member disposed above said vane to prevent falling objects from contacting said vane.

2. The apparatus of claim 1 wherein support means are provided for said vane and said protective member and said support means being attached to said plenum.

3. The apparatus of claim 2 wherein the means for attaching said support means to said plenum include members which interconnect said support means, protective member, nozzle and plenum member into a substantially rigid unit.

4. The apparatus of claim 1 wherein the vane comprises an elongated plate means, means for rotating said plate about its leading edge relative to the air stream about an axis adjacent the outlet of said nozzle, and transversely aligned slots in said plate means spaced along the length thereof to minimize distortion caused by heat.

* * * * *